United States Patent [19]

Montgomery

[11] 4,046,424

[45] Sept. 6, 1977

[54] CONTINUOUS MINING MACHINE WITH HINGED CUTTER GUIDE EXTENSIONS

[76] Inventor: Warren G. Montgomery, 2 Berwood Drive, Rte. 8, Morgantown, W. Va. 26505

[21] Appl. No.: 731,043

[22] Filed: Oct. 8, 1976

Related U.S. Application Data

[63] Continuation-in-part of Ser. No. 647,343, Jan. 8, 1976, abandoned.

[51] Int. Cl.[2] ..... E21C 35/12

[52] U.S. Cl. ..... 299/56; 299/64

[58] Field of Search ..... 299/56, 57, 64–68

[56] References Cited

U.S. PATENT DOCUMENTS

| | | | |
|---|---|---|---|
| 1,514,269 | 11/1924 | Straight | 299/64 |
| 2,798,706 | 7/1957 | Silver | 299/64 X |
| 3,314,722 | 4/1967 | Webster | 299/56 X |

FOREIGN PATENT DOCUMENTS

| | | | |
|---|---|---|---|
| 1,391,316 | 4/1975 | United Kingdom | 299/64 |

*Primary Examiner*—Ernest R. Purser
*Attorney, Agent, or Firm*—Pennie & Edmonds

[57] ABSTRACT

A continuous mining machine having a cutter head moveably mounted on a support guide with a center portion extending across the width of a carrier. The support guide has hinged end portions so that the end portions may be swung against the side of the carrier in order that the machine may be maneuvered in restricted areas. A gathering conveyor is positioned beneath the support guide and comprises two wing portions which may also be swung against the sides of the carrier.

6 Claims, 5 Drawing Figures

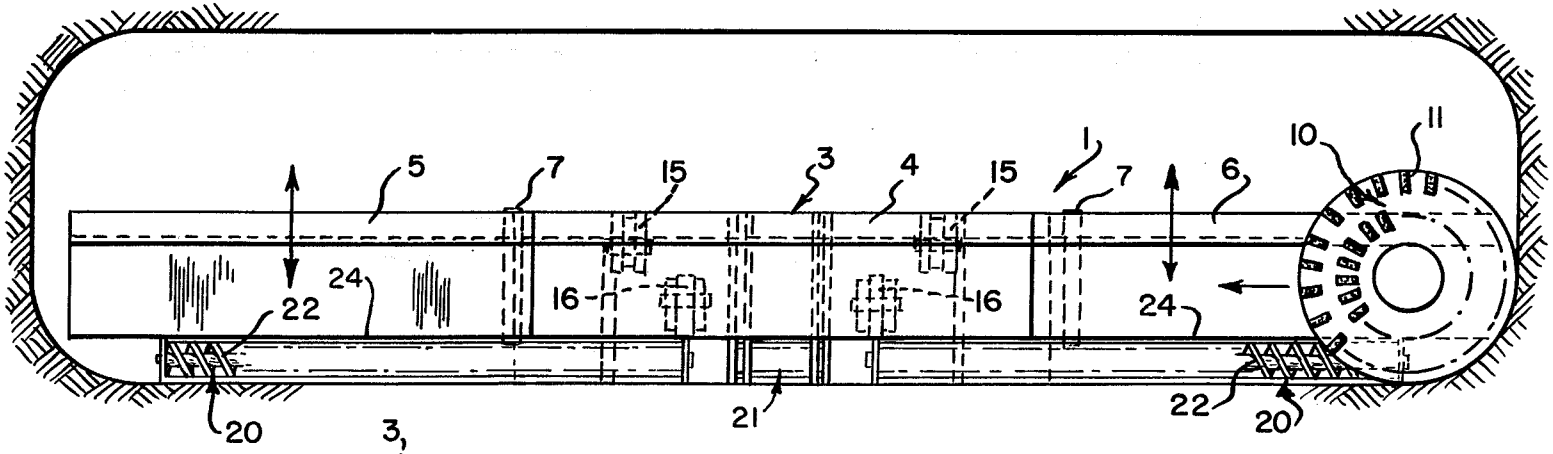
FIG. 2
FIG. 4
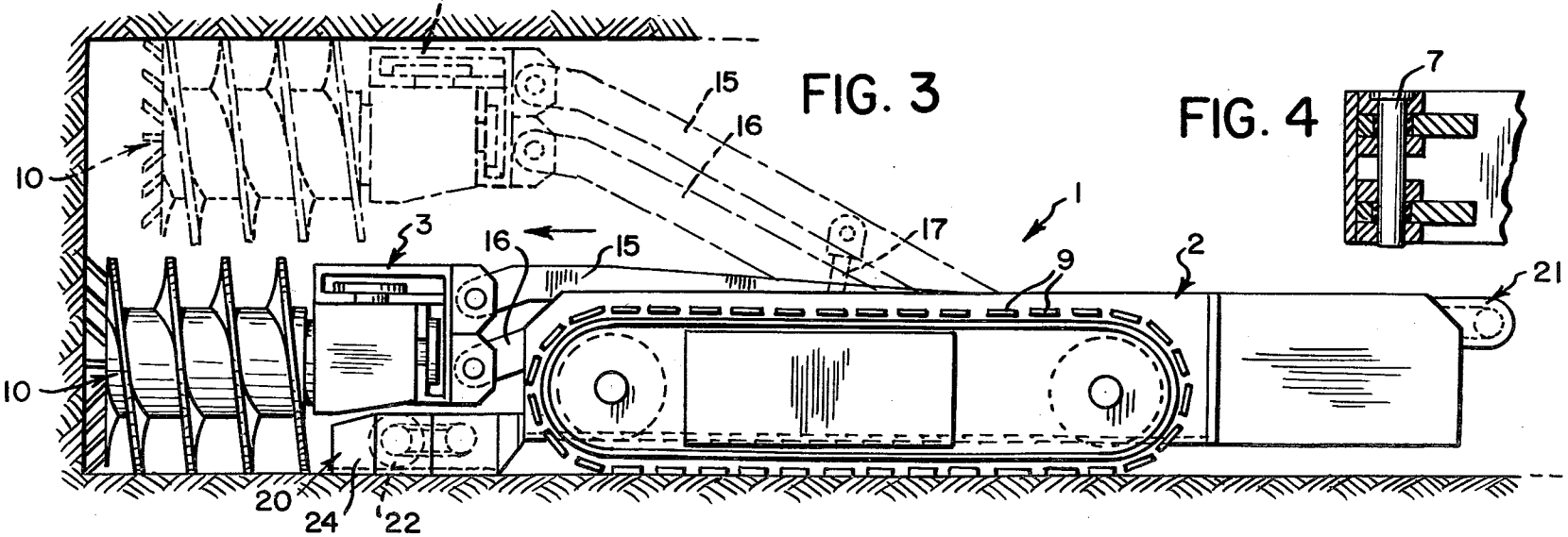
FIG. 3

CONTINUOUS MINING MACHINE WITH HINGED CUTTER GUIDE EXTENSIONS

REFERENCE TO OTHER APPLICATIONS

This application is a continuation-in-part of my copending application Ser. No. 647,343, filed Jan. 8, 1976 and now abandoned.

FIELD OF THE INVENTION

The invention relates to a continuous mining machine which comprises a carrier on which a support guide is mounted for vertical movement. A rotatble cutter head is slideably mounted on the support guide in order to make a kerf in a mine face which extends across the width of the machine. The end portions of the support guide are hinged at pivot points which are positioned beyond the side edges of the carrier so that the end portions may be swung in to lie against the side of the carrier in order that the machine may be maneuvered in restricted areas. The machine further has a gathering conveyor which extends parallel to and below the support guide and which comprises two wing portions which are pivoted on hinges positioned outwardly of the side edges of the carrier so that the conveyor wing portions may be swung in against the side of the conveyor in the same manner as the end portions of the support guide.

DESCRIPTION OF THE PRIOR ART

Continuous mining machines are known which include rotatable cutter heads mounted on support guides in order to cut material from a mine face such that the area cut may extend beyond the width of the machine in order that the machine may be advanced. The support guides of some machine constructions have retractable extensions which are moveable in a direction transverse to the machine axis, see for example U.S. Pat. No. 3,306,663. Other continuous mining machinery constructions utilize cutter heads which are moveable in arcuate directions so as to extend beyond the side of the machine or utilize cutting heads mounted on articulated arms, see for example U.S. Pat. Nos. 3,190,697 and 3,062,518. Such cutter head mountings require complicated linkages for providing sufficient support to the cutter head as well as involved drive means all of which increase the initial expense of the machine as well as increase maintenance costs. Such machines further require the use of complicated conveyor mechanisms for gathering of the material cut by the cutter head and transferring the material to further conveyors in order that it may be removed from the working area.

It is an object of my invention to provide for a continuous mining machine which will be able to cut a kerf extending beyond the width of the carrier mounting the machine where the machine utilizes a mounting for the cutting head which may be conveniently manufactured and subject to a minimum of maintenance. It is a further object to provide structure which may be easily maneuvered in restricted areas, as for example, between mine posts and around sharp turns.

SUMMARY OF THE INVENTION

Broadly, the invention comprises having a support guide mounted on a moveable carrier where the support guide extends across the front of the carrier. The support guide is moveable in a vertical direction and has pivotable portions on the end which portions pivot about a hinge mounted beyond the side edges of the carrier in order that the portions may be swung against the side of the carrier when it is necessary to maneuver the carrier in restricted areas. The support guide has a rotatable cutter thereon which is adapted to slide on the support. Means are provided for rotating the cutter head for moving it along the support guide and for moving the support guide in a vertical direction. Further a gathering conveyor is positioned parallel to and below the support guide. This conveyor comprises two pivotable wing portions mounted on hinge points mounted beyond the side edges of the carrier in order that the portions may be swung against the sides of the carrier. Preferably the gathering conveyor includes an auger mounted in each wing portion. The machine may also have a flight conveyor which extends along the length of the carrier for gathering material from the gathering conveyor and conveying it to other conveyors leading from the work area.

DESCRIPTION OF THE DRAWINGS

FIG. 2 is a front view of the mining machine of FIG. 1;

FIG. 3 is a side view of the mining machine of FIG. 1;

FIG. 4 is an enlarged section of FIG. 1 taken along lines IV—IV; and

DESCRIPTION OF THE PREFERRED EMBODIMENT

Figure 1:
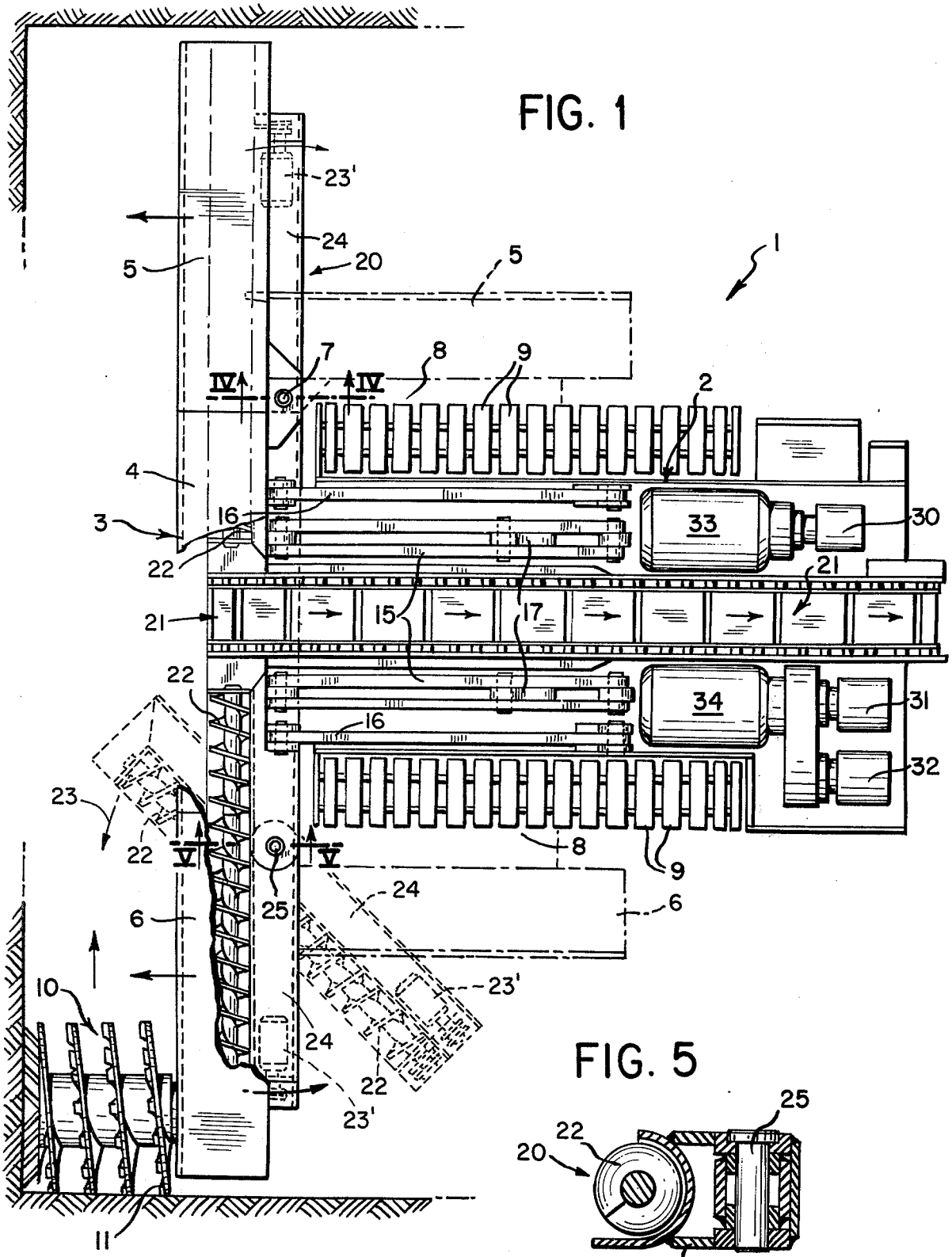
FIG. 1 is a plan view of a continuous mining machine constructed according to the invention with parts broken away.
Figure 5:
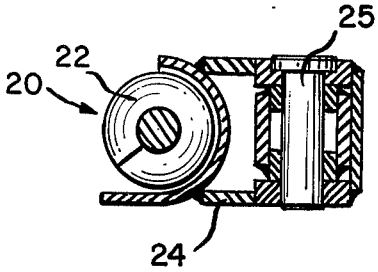
FIG. 5 is an enlarged section of FIG. 1 taken along lines V—V.

Referring to FIG. 1 of the drawings, there is illustrated a continuous mining machine 1 comprising a crawler-type carrier 2 having a support guide 3 mounted for vertical movement with respect to the carrier. The support guide 3 comprises a center portion 4 and two end portions 5 and 6. The end portion 5 is moveably supported by a hinge 7 mounted on the carrier where the pivot axis of the hinge is positioned beyond the side 8 of the crawler treads 9 supporting the carrier. This construction allows the end support guide 5 to be swung against the side of the machine as shown by the dotted lines. The end portion 6 is similarly mounted.

A rotatable cutter head 10 is mounted on the support guide so as to slide along its length. The cutter head 10 may be driven by a hydraulic motor and likewise moved along the support guide by cables connected to a hydraulic motor. As shown in FIGS. 1 and 2 the cutting edges 11 of the cutter head extend beyond the end of the support guide and further, as shown in FIG. 3, extend over and below the vertical cross-section of the support guide. This construction assures that the kerf cut in an operating mine face will extend beyond the support guide such that the machine may be moved forwardly upon completion of a cut.

The support guide is carried by arms 15 and 16 which are in turn moved by a hydraulic piston 17 to move the support guide vertically.

In completing a cut, the support guide is initially raised and the cutter head moved to a first end of the support guide. A cut is commenced with the machine moving forward until the cutter head has penetrated into the operating face to the desired depth. The cutter head is then moved along the length of the support guide to its opposite or second end. The support guide is lowered and the cutter head moved back over the length of the support guide while cutting of the mine face. When the cutter head reaches the first end of the support guide, the cycle is complete and the machine is in position to commence a new cycle.

A gathering conveyor 20 is positioned parallel to and below the support guide to gather material cut by the cutter head and move it to the center of the machine where the material drops onto a flight conveyor 21 which extends along the length of the carrier. Flight conveyor 21 in turn conveys the material to other conveyors for removal from the work area.

The gathering conveyor 20 comprises an auger on the left side of the machine and a similar auger, not shown, on the right side of the machine. Auger 22 and its supporting structure 24 together form a conveyor wing portion which is supportedly mounted by a hinge 25 the pivot axis of which extends beyond the side of the carrier as shown in FIG. 1. A hydraulic drive motor 23' carrier in the outer end of the support structure is connected by a drive belt to the outer end of the auger to provide a drive means for the auger. By this construction, the auger 22 and its supporting structure may be swung in the direction of the arrow 23 against the side of the machine, as shown by the dotted lines in FIG. 1, in the same manner as is the support guide in order that the machine may maneuvered in restricted areas such as between mine support posts or in making sharp turns. A hydraulic motor, not shown, may be connected to the end support guide as well as the conveyor wing portion to provide the means to move the portions on their hinges. When the end portions of the support guide and the wing portions of the gathering conveyor are retracted, the cutter head is positioned on the center guide portion 4.

The carrier has conventional hydraulic pumps 30, 31 and 32 driven by motors 33 and 34 where the pumps provide the power necessary to move the crawler, guide support, conveyors and the cutter head.

The machine as shown in FIG. 3 has a low vertical profile allowing it to be operated in mines having narrow seams. Further the use of the folding end support guide portions and gathering conveyor wing portions provide a strong and inexpensive structure needing a minimum of maintenance resulting in a continuous mining machine which may be easily maneuvered in restricted areas.

I claim:

1. A continuous mining machine having a moveable carrier, a cutter head, a horizontal support guide extending across the front end of said carrier for supporting said cutter head for slideable movement thereon, a gathering conveyor extending across the front end of said carrier parallel to and beneath said support guide, and a flight conveyor extending over the length of said carrier to convey material received from said gathering conveyor; the improvement comprising in that a guide end portion of said support guide is adapted to extend over a side edge of said carrier, and in having a guide hinge with a pivot point positioned beyond the side edge of said carrier for supporting said guide end portion whereby said guide end portion may be moved from a position extending across the carrier to a position extending along a side of the carrier.

2. A continuous mining machine according to claim 1 wherein said gathering conveyor comprises at least one wing portion adapted to extend beyond the side edge of said carrier and in having a conveyor hinge with a pivot point positioned beyond the side edge of said carrier whereby said conveyor wing portion may be moved from a position extending across the carrier to a position extending along a side of the carrier.

3. A continuous mining machine according to claim 2 wherein said gathering conveyor further comprises an auger in each wing portion.

4. A continuous mining machine according to claim 1 wherein said cutter head at an extreme end limit of its movement on said support guide has cutting portions extending beyond an end of said guide whereby the cutter head may make a kerf extending beyond the end of the guide.

5. A continuous mining machine comprising a moveable carrier, a horizontal support guide mounted on said carrier for vertical movement with said support guide having a center guide portion extending across the width of said carrier and an end guide portion at each end of said center guide portion, a rotatable circular cutter head moveably mounted on said support guide, means for rotating said cutter head, means for moving said cutter head along said support guide, means for moving said support guide vertically, and guide hinge means located beyond the side edges of said carrier and supporting said end guide portions whereby said end guide portions may be moved from a position extending parallel to said center guide portion to a position extending along a side of the carrier.

6. A continuous mining machine according to claim 5 having in addition a gathering conveyor comprising two conveyor wing portions and a conveyor hinge means located beyond each side edge of said carrier and supporting one of said conveyor wing portions whereby said conveyor wing portions may be moved from a position extending parallel to said center guide portion to a position extending along a side of the carrier.

* * * * *